US005647792A

United States Patent [19]

Katsuoka et al.

[11] Patent Number: 5,647,792

[45] Date of Patent: Jul. 15, 1997

[54] POLISHING APPARATUS

[75] Inventors: Seiji Katsuoka, Atsugi; Kunihiko Sakurai, Yokohama; Tetsuji Togawa, Fujisawa, all of Japan

[73] Assignee: Ebara Corporation, Tokyo, Japan

[21] Appl. No.: 580,341

[22] Filed: Dec. 28, 1995

[30] Foreign Application Priority Data

Dec. 28, 1994 [JP] Japan ..... 6-339168

[51] Int. Cl.[6] ..... B24B 5/00

[52] U.S. Cl. ..... 451/285; 451/287; 451/288; 269/236

[58] Field of Search ..... 451/41, 285, 287, 451/288, 289; 269/234, 236, 305

[56] References Cited

U.S. PATENT DOCUMENTS

| | | | |
|---|---|---|---|
| 3,968,598 | 7/1976 | Ogawa | 451/288 |
| 4,206,910 | 6/1980 | Biesemeyer | 269/236 |
| 4,527,358 | 7/1985 | Day | 451/287 |
| 5,310,455 | 5/1994 | Pasch et al. | 451/288 |

*Primary Examiner*—Willis Little
*Assistant Examiner*—Eileen P. Morgan
*Attorney, Agent, or Firm*—Wenderoth, Lind & Ponack

[57] ABSTRACT

A polishing apparatus has a cloth cartridge detachably mounted on a turntable, an abrasive liquid nozzle for supplying an abrasive liquid onto an abrasive cloth of the cloth cartridge, and a top ring for holding a workpiece against the abrasive cloth. The turntable and the top ring are rotatable relatively to each other while the abrasive liquid is being supplied onto the abrasive cloth from the abrasive liquid nozzle and the workpiece is being held against the abrasive cloth. A cartridge tightener which is angularly movably mounted on the turntable has a tapered surface for engaging an engageable surface of the cloth cartridge in response to angular movement of the cartridge tightener. The tapered surface is included to a plane substantially perpendicular to an axis about which the turntable is rotatable. The cartridge tightener also has a resilient member acting between the tapered surface and the turntable and elastically deformable for applying resilient forces between the tapered surface and the engageable surface in response to angular movement of the cartridge tightener.

22 Claims, 5 Drawing Sheets

POLISHING APPARATUS

BACKGROUND OF THE INVENTION

1. Field of the Invention

The present invention relates to a polishing apparatus, and more particularly to a polishing apparatus for polishing a workpiece such as a semiconductor wafer or the like to a flat mirror finish.

2. Description of the Prior Art

As semiconductor devices become more highly integrated in recent years, circuit interconnections become thinner and the distances between those interconnections also become smaller. Photolithographic processes for producing interconnections that are 0.5 μm wide or smaller, particularly, require a flat image-focusing plane for the stepper because the depth between focal points is small.

Therefore, it is necessary to make the surface of a semiconductor wafer flat before fine circuit interconnections are formed thereon. According to one customary process, semiconductor wafers are polished to a flat finish by a polishing apparatus.

One conventional polishing apparatus comprises a turntable with an abrasive cloth attached to its upper surface and a top ring disposed in confronting relationship to the upper surface of the turntable, the turntable and the top ring being rotatable at respective independent speeds. The top ring is pressed against the turntable to impart a certain pressure to a workpiece which is interposed between the abrasive cloth and the top ring. While an abrasive liquid containing abrasive material is supplied onto the upper surface of the abrasive cloth, the surface of the workpiece is polished to a flat mirror finish by the abrasive cloth which has the abrasive material thereon, during relative rotation of the top ring and the turntable.

To replace the abrasive cloth on the turntable, the polishing apparatus is shut down, and the abrasive cloth is detached from the turntable. Then, any abrasive liquid that remains on the upper surface of the turntable is washed away. After the turntable is dried, a new abrasive cloth is attached directly to the upper surface of the turntable. The above replacement process is not efficient as it is tedious and time-consuming. Because the downtime of the polishing apparatus is long due to the abrasive cloth replacement, the number of production lots per unit time yielded by the polishing apparatus is small.

One solution to the above problems has been to use a cloth cartridge having an abrasive cloth attached to a base, the cloth cartridge being detachably mounted on the turntable. The abrasive cloth can be replaced by replacing the existing cartridge with a new cartridge having a fresh abrasive cloth. Use of such a replaceable cloth cartridge is effective in shortening the cloth replacement process and hence the downtime of the polishing apparatus, so that the number of production lots per unit time yielded by the polishing apparatus can be increased. The cloth replacement process using the cloth cartridge is disclosed in U.S. Pat. No. 4,527,358, for example.

There have been known various mechanisms by which the turntable and the cloth cartridge are detachably fixed to each other. For example, Japanese patent publication No. 59-44185 discloses an arrangement in which the outer circumferential edge of the cloth cartridge is fastened by bolts to the turntable through a holder ring. Japanese laid-open patent publication No. 4-206929 discloses another structure which has interfitting members disposed in corresponding positions on the cloth cartridge and the turntable.

The former mechanism allows the outer circumferential edge of the cloth cartridge to be securely fastened by bolts to the turntable, but is disadvantageous in that replacing the cloth cartridge is tedious and time-consuming because it is necessary to loosen and re-tighten the bolts. With the latter structure, the cloth cartridge can easily be mounted on and dismounted from the turntable by the interfitting members, which are however subject to a certain degree of play. Particularly, when a localized load is imparted from the top ring to the cloth cartridge during a polishing process, the cloth cartridge tends to be displaced, adversely affecting a smooth polishing action and the flatness of the workpiece that is being polished.

SUMMARY OF THE INVENTION

It is therefore an object of the present invention to provide a polishing apparatus which has a cloth cartridge that can easily be attached and detached and can securely be fixed in position so that the cloth cartridge can be replaced efficiently and a workpiece such as a semiconductor wafer can be polished to a desired level of quality.

To achieve the above object, there is provided in accordance with the present invention a polishing apparatus comprising: a turntable; a cloth cartridge having a base and an abrasive cloth attached to the base, the cloth cartridge being detachably mounted on the turntable, the cloth cartridge having an engageable surface; a top ring for holding a workpiece against the abrasive cloth; rotating means for rotating the turntable and the top ring relatively to each other while the workpiece is being held against the abrasive cloth; and a cartridge tightener mounted on the turntable and capable of occupying at least two positions relative to the turntable; the cartridge tightener being capable of fixing the cloth cartridge to the turntable by engaging with the engageable surface of the cloth cartridge when the cartridge tightener is in the first position, and releasing the cloth cartridge from the turntable when the cartridge tightener is in the second position.

The cartridge tightener may preferably comprise a tapered surface which is engageable with the engageable surface when the cartridge tightener is in the first position for exerting forces to the engageable surface in response to movement of the cartridge tightener from the second position to the first position so that the tightening operation is easy and smooth as well as reliable.

The cartridge tightener may change its position by an angular movement about an axis substantially parallel to a rotational axis of the turntable.

Further, the cartridge tightener may comprise a resilient member acting between the tapered surface and the turntable and elastically deformable for applying resilient forces between the tapered surface and the engageable surface in response to angular movement of the cartridge tightener, thereby clamping the cartridge firmly enough to avoid unintentional movement during polishing.

The resilient member may comprise a spring or an elastomeric member.

In another aspect of the invention, the polishing apparatus may further comprise positioning means for positioning the cloth cartridge with respect to the turntable.

The positioning means may comprises a projection provided on one of the cloth cartridge and the turntable, and a recess provided on the other of the cloth cartridge and the turntable and being engageable with the protection.

In another aspect of the invention, the polishing apparatus may further comprise locking means for locking the cartridge tightener against further angular movement.

The locking means may comprise a pin which is provided on a chuck unit block fixed to the turntable and is movable vertically, and a slit which is provided on the cartridge tightener and is engageable with the pin.

The polishing apparatus should preferably have a plurality of cartridge tighteners spaced circumferentially around the turntable. The engageable surface may be positioned in any location on the cloth cartridge, but should preferably be defined as a lower surface of a recess defined in a side of the cloth cartridge. If the engageable surface is defined as the lower surface of the recess defined in the side of the cloth cartridge, then the cartridge tightener has a segmental recess which faces the cloth cartridge when the cartridge tightener is in a released position. The cartridge tightener may be angularly moved by a suitable jig such as a wrench having a forked tip end that can be inserted in slots defined in the cartridge tightener. The resilient member may comprise any member insofar as it can apply necessary resilient forces. For example, the resilient member may be a Belleville spring or a coil spring which is made of metal or plastic, or an elastomeric member such as a member of rubber, plastic, or the like.

With the above arrangement of the present invention, when the cartridge tightener is angularly moved, the tapered surface thereof is brought into engagement with the engageable surface, thereby producing forces tending to press the turntable and the cloth cartridge against each other through a wedging action. Under the produced forces, the resilient member is elastically deformed thereby to apply resilient forces between the tapered surface and the engageable surface. Since the resilient member is elastically deformable to a substantially constant degree, the forces applied between the tapered surface and the engageable surface are also substantially constant.

The above and other objects, features, and advantages of the present invention will become apparent from the following description when taken in conjunction with the accompanying drawings which illustrate a preferred embodiment of the present invention by way of example. dr

DETAILED DESCRIPTION OF THE PREFERRED EMBODIMENT

Figure 1:
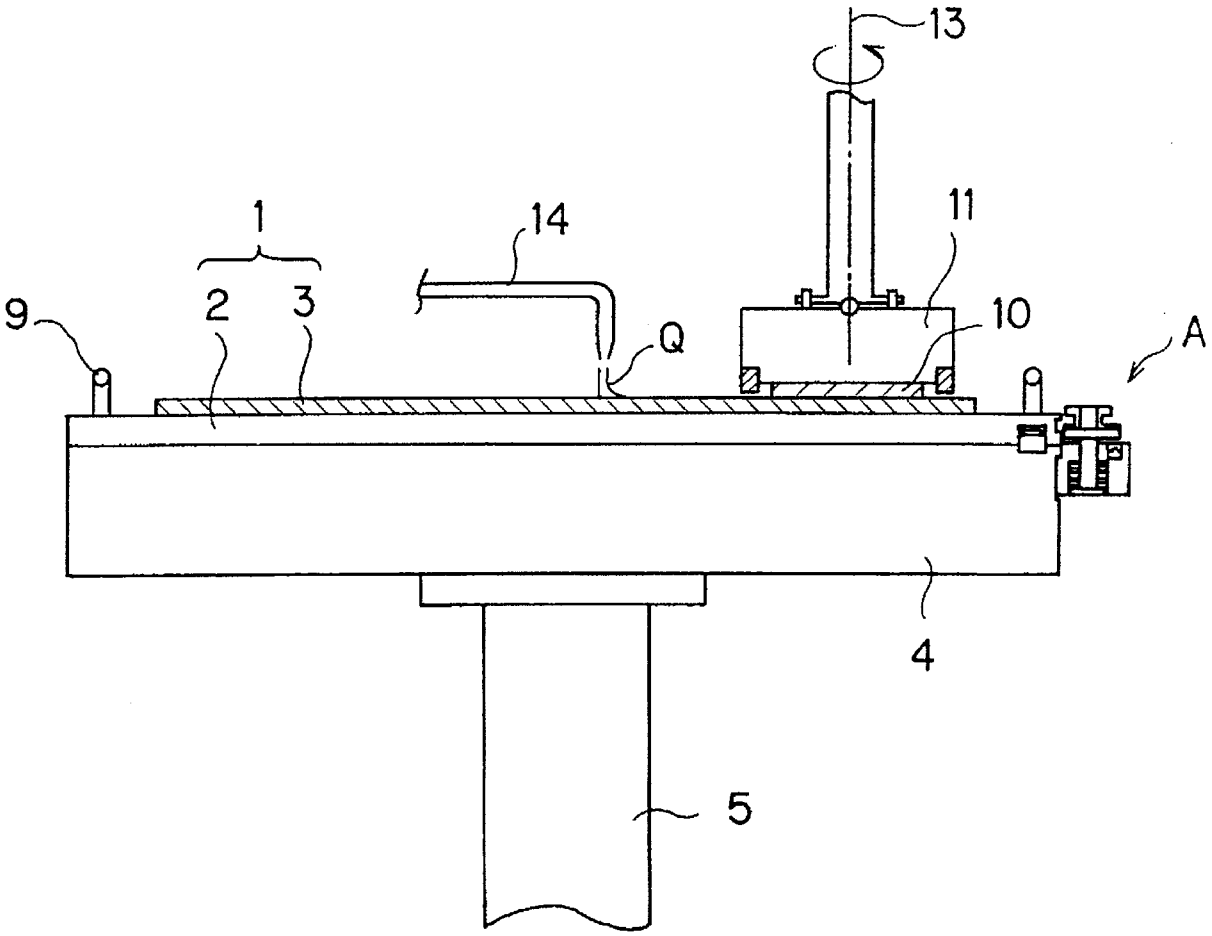
FIG. 1 is a vertical cross-sectional view of a polishing apparatus according to the present invention.

As shown in FIG. 1, a polishing apparatus according to the present invention has a cloth cartridge 1 comprising a base 2 and an abrasive cloth 3 attached to an upper surface of the base 2, a turntable 4 on which the cloth cartridge 1 is replaceably mounted, and a chuck unit A which fixes the cloth cartridge 1 removably to an upper surface of the turntable 4. Actually, a plurality of chuck units A are positioned at equal circumferential intervals around the outer circumferential edge of the turntable 4. However, only one chuck unit A is illustrated for the sake of brevity. The turntable 4 is rotatable about its own axis by a vertical rotating shaft 5 which is fixed coaxially to the lower surface of the turntable 4 and connected to a drive motor or the like. When the turntable 4 is rotated, the cloth cartridge 1 fixedly mounted thereon also rotates in unison with the turntable 4.

The polishing apparatus also includes a top ring 11 which holds a semiconductor wafer 10 to be polished on its lower surface. The top ring 11 can be rotated about a vertical axis 13 by a rotating shaft coupled thereto, and can also be vertically moved to press the semiconductor wafer 10 downwardly against the abrasive cloth 3 under a desired pressure.

An abrasive liquid nozzle 14 is disposed directly above the turntable 4 for supplying an abrasive liquid Q onto the abrasive cloth 3 attached to the base 2.

Figure 2A:
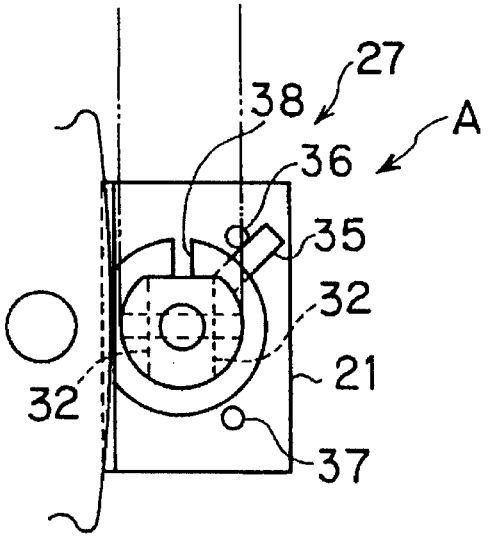
FIG. 2A is a plan view of a chuck unit, as it is released, of the polishing apparatus.
Figure 2B:
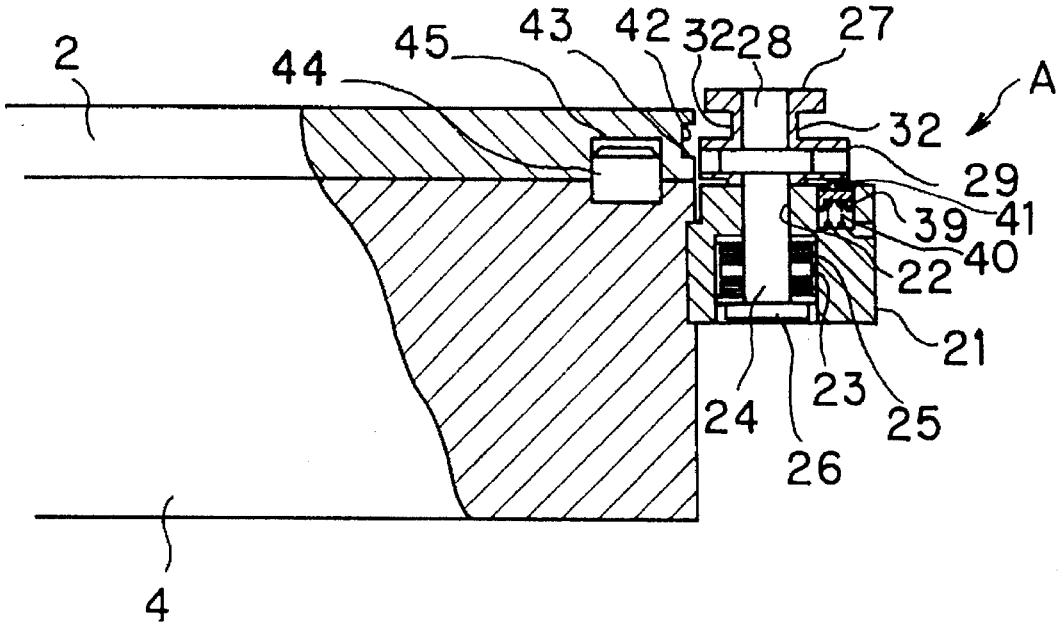
FIG. 2B is a sectional front elevational view of the chuck unit shown in FIG. 2A.

FIGS. 2A and 2B show the chuck unit A at an enlarged scale. As shown in FIGS. 2A and 2B, the chuck unit A has a chuck unit block 21 fixed to a side of the turntable 4 and having a vertical support hole 22 defined therein and a spring housing cavity 23 defined therein immediately below the vertical support hole 22 and opening downwardly. A shaft 24 extends through the vertical support hole 22 and is supported for vertical and circumferential sliding movement therein. A Belleville spring 25 is disposed in the spring housing cavity 23 and acts between a spring retainer flange 26 on the lower end of the shaft 24 and the upper wall of the spring housing cavity 23 for normally urging the shaft 24 to move axially downwardly.

A cartridge tightener 27, which is shown in greater detail in FIGS. 4A through 4C and 5A through 5C, is fixed to the upper end of the shaft 24 which projects upwardly from an upper surface of the chuck unit block 21. The cartridge tightener 27 comprises a cylindrical body having a central shaft hole 28 defined vertically therein with the shaft 24 extending through the central shaft hole 28. The cartridge tightener 27 has an engaging flange 29 on the lower end thereof which extends circumferentially and projects radially outwardly. The cartridge tightener 27 also has a pair of diametrically opposite slots 32 defined above the engaging flange 29 for receiving a forked tip end 31 (see FIG. 3A) of a wrench 30 which is applied to turn the cartridge tightener 27. The engaging flange 29 is of a substantially disk shape with a segmental recess defined therein, as viewed in plan. As shown in FIGS. 4A through 4C and 5A through 5C, the engaging flange 29 has, on its lower surface, a tapered surface 33 which is inclined circumferentially to a plane substantially perpendicular to the shaft 24 and a flat surface 34 contiguous to the tapered surface 33 parallel to the plane.

A rod 35 projects radially outwardly from an outer circumferential surface of the engaging flange 29 at its lower end. Two spaced stops 36, 37 which project upwardly are mounted on an upper surface of the chuck unit block 21. When the cartridge tightener 27 is angularly moved about the axis of the shaft 24 by the wrench 30, the rod 35 is brought into engagement with one of the stops 36, 37 which prevents the cartridge tightener 27 from being further angularly moved.

The engaging flange 29 has a radial slit 38 (see FIG. 2A) defined therein at a position between the slots 32, and a lock pin 41 (see FIG. 2B) which is biased to move upwardly by a spring 40 is mounted in a cavity 39 defined in the upper surface of the chuck unit block 21 at a position spaced across the shaft 24 from the turntable 4. When the cartridge tightener 27 is angularly moved until the slit 38 is positioned above the lock pin 41, the lock pin 41 moves upwardly into the slit 38 under the bias of the spring 40, thereby locking the cartridge tightener 27 against further angular movement.

As shown in FIG. 2B, a recess 42 is defined in a side of the cloth cartridge 1 which is aligned with the chuck unit A. The recess 42 has an engageable lower surface 43 which can be engaged by the tapered surface 33 of the engaging flange 29 upon rotation of the cartridge tightener 27 as described later on.

A positioning pin 44 is fixed to the upper surface of the turntable 4 at a predetermined position. The positioning pin 44 is fitted in a recess 45 defined in a lower surface of the base 2 for thereby positioning the cloth cartridge 1 circumferentially with respect to the turntable 4.

Figure 3A:
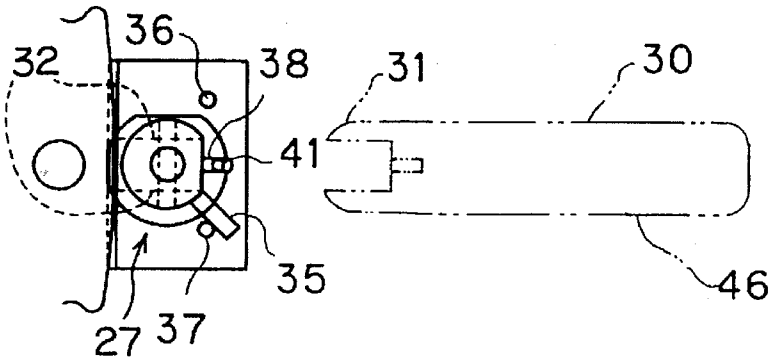
FIG. 3A is a plan view of the chuck unit, as it is tightened.
Figure 3B:
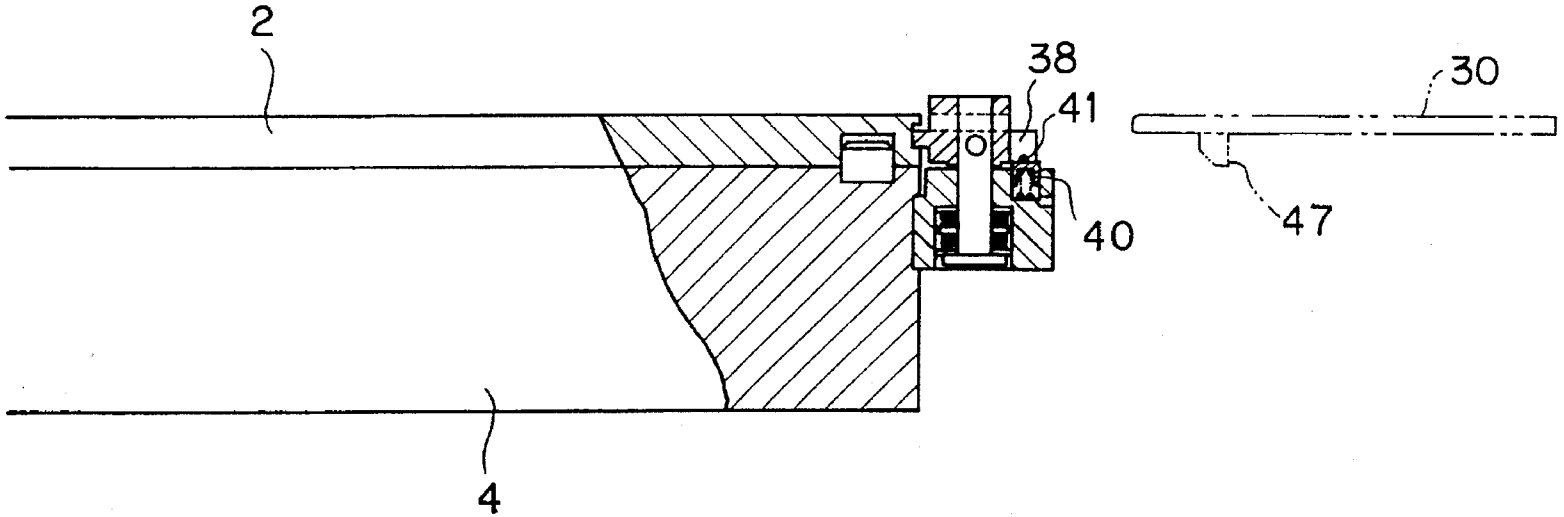
FIG. 3B is a sectional front elevational view of the chuck unit shown in FIG. 3A.

As shown in FIGS. 3A and 3B, the wrench 30 comprises a handle 46 which has the forked tip end 31 for being received in the slots 32 in the cartridge tightener 27. The wrench 30 also has a release finger 47 projecting downwardly from a lower surface thereof near the forked tip end 31. When the forked tip end 31 is inserted in the slots 32 in the cartridge tightener 27, the release finger 47 engages and lowers the lock pin 41 out of the slit 38 against the bias of the spring 40, thus releasing the cartridge tightener 27 for angular movement on the chuck unit block 21.

Figures 4A, 4B, 4C:
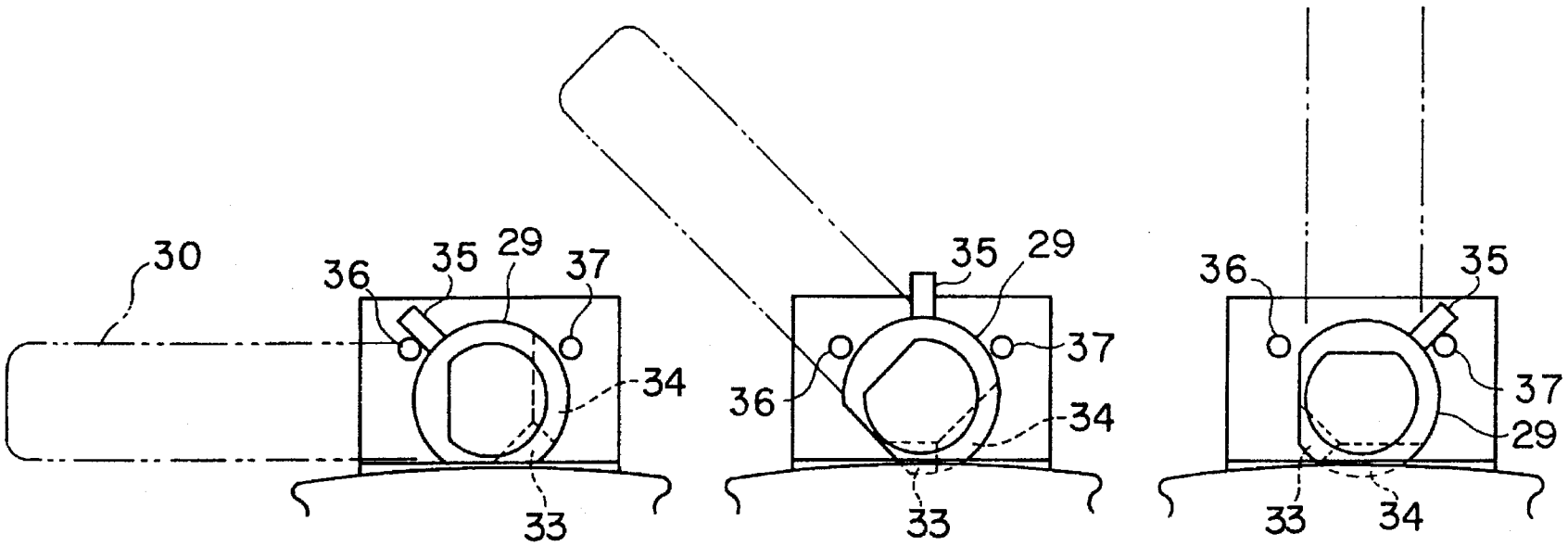
FIGS. 4A through 4C are plan views showing a progressive operation of the chuck unit, FIG. 4A being illustrative of a released position of the chuck unit, FIG. 4B of an intermediate position thereof, and FIG. 4C of a tightened position thereof.
Figure 5A:
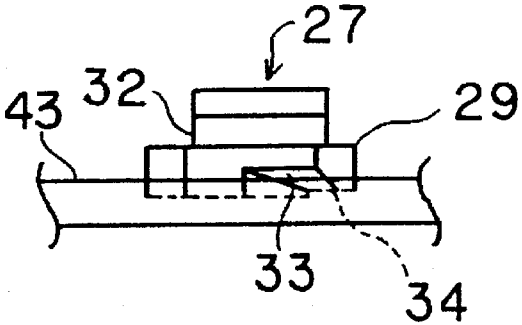
FIGS. 5A through 5C are side elevational views of the chuck unit, showing the released, intermediate, and tightened positions, respectively, of the chuck unit.
Figure 5B:
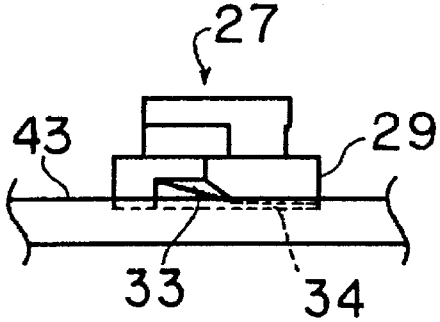
Figure 5C:
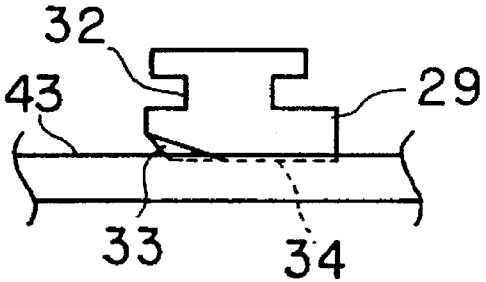

A process of installing the cloth cartridge 1 on the turntable 4 will be described below. It is assumed that the cartridge tightener 27 is in a position in which the rod 35 engages the stop 36 as shown in FIGS. 2A and 4A. At this time, since the segmental recess of the engaging flange 29 faces the turntable 4, the engaging flange 29 is out of physical interference with the cloth cartridge 1. The cloth cartridge 1 is placed on the turntable 4 with the positioning pin 44 inserted in the recess 45 in the base 2. The cloth cartridge 1 is now positioned with respect to the turntable 4.

The wrench 30 with its forked tip end 31 inserted in the slots 32 is turned clockwise (FIGS. 4A) about 45° to angularly move the cartridge tightener 27 also through about 45° about the shaft 24. The tapered surface 33 of the engaging flange 29 now engages the engageable lower surface 43 of the cloth cartridge 1 (see FIGS. 4B and 5B). Further clockwise angular movement of the wrench 30 causes the tapered surface 33 to push the engageable lower surface 43, pressing the cloth cartridge 1 downwardly. When reactive forces applied to the engaging flange 29 by the engageable lower surface 43 reach a certain level, the cartridge tightener 27 starts being displaced upwardly while flexing the Belleville spring 25. Forces depending on the extent to which the Belleville spring 25 is flexed are applied between the tapered surface 33 and the engageable lower surface 43, i.e., between the cloth cartridge 1 and the turntable 4.

Upon continued clockwise angular movement of the wrench 30, as shown in FIG. 4C, the engageable lower surface 43 is engaged by the flat surface 34 (see FIG. 5C), and the rod 35 is held against the stop 37. At this time, the cloth cartridge 1 is stably tightened on the turntable 4. The wrench 30 is thereafter removed from the cartridge tightener 27, whereupon the lock pin 41 projects upwardly into the slit 38 under the bias of the spring 40, as shown in FIGS. 3A and 3B.

The cloth cartridge 1 is now fastened to the turntable 4 by the illustrated chuck unit A. The other non-illustrated chuck units A are similarly operated to completely fasten the cloth cartridge 1 to the turntable 4. The above process is reversed to remove the cloth cartridge 1 from the turntable 4 for replacement.

In the chuck unit A, the Belleville spring 25 resiliently acts between the cartridge tightener 27 and the turntable 4 to absorb a relative axial displacement thereof which is produced by a wedging action upon sliding engagement between the tapered surface 33 and the engageable surface 43. Therefore, even if the cloth cartridge 1 and the chuck unit A suffer a low dimensional accuracy when they are manufactured or assembled, the cloth cartridge 1 and the turntable 4 are prevented from suffering excessively large or small fastening forces at the time the cartridge tightener 27 is angularly moved from the released position shown in FIGS. 4A and 5A to the tightened position shown in FIGS. 4C and 5C. Consequently, the cloth cartridge 1 and the turntable 4 are prevented from being unduly strained or insufficiently fastened to each other. Since any of the chuck units A can apply substantially uniform fastening forces upon elastic deformation of the Belleville spring 25, the cloth cartridge 1 is secured to the turntable 4 under uniform forces by the chuck units A. Furthermore, inasmuch as the lock pin 41 locks the cartridge tightener 27 against angular movement in the tightened position, the cartridge tightener 27 is prevented from being accidentally turned, and hence the cloth cartridge 1 is also prevented from being loosened, while the semiconductor wafer 10 is being polished by the polishing apparatus. Accordingly, the semiconductor wafer 10 can be polished to a desired level of quality.

Because the cartridge tightener 27 can easily be turned by the wrench 30 to tighten or release the cloth cartridge 1 quickly, the cloth cartridge 1 can easily and quickly be mounted on and dismounted from the turntable 4 highly efficiently. In addition, when in the tightened position, the cloth cartridge 1 can firmly be secured to the turntable 4 under the resilient forces applied by the Belleville spring 25.

The Belleville spring 25 may be replaced with a coil spring or any of various other springs, or with an elastomeric member such as a member of rubber, plastic, or the like insofar as they can exert necessary resilient forces.

Although a certain preferred embodiment of the present invention has been shown and described in detail, it should be understood that various changes and modifications may be made therein without departing from the scope of the appended claims.

What is claimed is:

1. A polishing apparatus comprising:

a turntable;

a cloth cartridge having a base and an abrasive cloth attached to said base, said cloth cartridge being detachably mounted on said turntable, said cloth cartridge having an engageable surface;

a top ring for holding a workpiece against said abrasive cloth;

rotating means for rotating said turntable and said top ring relative to each other while the workpiece is being held against said abrasive cloth; and a cartridge tightener mounted on said turntable and capable of occupying at least two positions relative to said turntable, said cartridge tightener being capable of fixing said cloth cartridge to said turntable by engaging with said engageable surface of said cloth cartridge when said cartridge tightener is in a first position of said positions and of releasing said cloth cartridge from said turntable when said cartridge tightener is in a second position of said positions.

2. The polishing apparatus according to claim 1, wherein said cartridge tightener comprises a tapered surface which is engageable with said engageable surface when said cartridge tightener is in said first position for exerting forces to said engageable surface in response to movement of said cartridge tightener from said second position to said first position.

3. The polishing apparatus according to claim 2, wherein said cartridge tightener changes its position by an angular movement about an axis substantially parallel to a rotational axis of said turntable.

4. The polishing apparatus according to claim 3, wherein said cartridge tightener comprises a resilient member acting between said tapered surface and said turntable and elastically deformable for applying resilient forces between said tapered surface and said engageable surface in response to angular movement of said cartridge tightener.

5. The polishing apparatus according to claim 4, wherein said resilient member comprises a spring.

6. The polishing apparatus according to claim 4, wherein said resilient member comprises an elastomeric member.

7. The polishing apparatus according to claim 1, further comprising positioning means for positioning said cloth cartridge with respect to said turntable.

8. The polishing apparatus according to claim 7, wherein said positioning means comprises a projection provided on one of said cloth cartridge and said turntable, and a recess provided in the other of said cloth cartridge and said turntable and being engageable with said projection.

9. The polishing apparatus according to claim 4, further comprising locking means for locking said cartridge tightener against further angular movement.

10. The polishing apparatus according to claim 9, wherein said locking means comprises a pin which is provided on a chuck unit block fixed to said turntable and is movable vertically, and a slit which is provided on said cartridge tightener and is engageable with said pin.

11. The polishing apparatus according to claim 4, further comprising a flat surface continuously provided from said tapered surface and being engageable with said engageable surface under said resilient forces of said resilient member.

12. A polishing apparatus comprising:

a turntable;

a cloth cartridge having a base and an abrasive cloth attached to said base, said cloth cartridge being detachably mounted on said turntable, said cloth cartridge having an engageable surface; and a cartridge tightener mounted on said turntable and capable of occupying at least two positions relative to said turntable, said cartridge tightener being capable of fixing said cloth cartridge to said turntable by engaging with said engageable surface of said cloth cartridge when said cartridge tightener is in a first position of said positions and of releasing said cloth cartridge from said turntable when said cartridge tightener is in a second position of said positions.

13. The polishing apparatus according to claim 12, wherein said cartridge tightener comprises a tapered surface which is engageable with said engageable surface when said cartridge tightener is in said first position for exerting forces to said engageable surface in response to movement of said cartridge tightener from said second position to said first position.

14. The polishing apparatus according to claim 13, wherein said cartridge tightener changes its position by an angular movement about an axis substantially parallel to a rotational axis of said turntable.

15. The polishing apparatus according to claim 14, wherein said cartridge tightener comprises a resilient member acting between said tapered surface and said turntable and elastically deformable for applying resilient forces between said tapered surface and said engageable surface in response to angular movement of said cartridge tightener.

16. The polishing apparatus according to claim 15, wherein said resilient member comprises a spring.

17. The polishing apparatus according to claim 15, wherein said resilient member comprises an elastomeric member.

18. The polishing apparatus according to claim 15, further comprising locking means for locking said cartridge tightener against further angular movement.

19. The polishing apparatus according to claim 18, wherein said locking means comprises a pin which is provided on a chuck unit block fixed to said turntable and is movable vertically, and a slit which is provided on said cartridge tightener and is engageable with said pin.

20. The polishing apparatus according to claim 15, further comprising a flat surface continuously provided from said tapered surface and being engageable with said engageable surface under said resilient forces of said resilient member.

21. The polishing apparatus according to claim 12, further comprising positioning means for positioning said cloth cartridge with respect to said turntable.

22. The polishing apparatus according to claim 21, wherein said positioning means comprises a projection provided on one of said cloth cartridge and said turntable, and a recess provided in the other of said cloth cartridge and said turntable and being engageable with said projection.

* * * * *